US012157932B2

(12) United States Patent
Li

(10) Patent No.: US 12,157,932 B2
(45) Date of Patent: Dec. 3, 2024

(54) NICOCRAL BASED ALLOY, A POWDER, A COATING AND A COMPONENT

(71) Applicant: Siemens Energy Global GmbH & Co. KG, Bayern (DE)

(72) Inventor: Xin-Hai Li, Linkoping (SE)

(73) Assignee: Siemens Energy Global GmbH & Co. KG, Bayern (DE)

( * ) Notice: Subject to any disclaimer, the term of this patent is extended or adjusted under 35 U.S.C. 154(b) by 0 days.

(21) Appl. No.: 18/029,909

(22) PCT Filed: Sep. 24, 2021

(86) PCT No.: PCT/EP2021/076389
§ 371 (c)(1),
(2) Date: Apr. 1, 2023

(87) PCT Pub. No.: WO2022/078735
PCT Pub. Date: Apr. 21, 2022

(65) Prior Publication Data

US 2023/0366067 A1 Nov. 16, 2023

(30) Foreign Application Priority Data

Oct. 14, 2020 (EP) ..... 20201756

(51) Int. Cl.

| | |
|---|---|
| ***C22C 19/05*** | (2006.01) |
| ***B22F 1/10*** | (2022.01) |
| ***B22F 1/12*** | (2022.01) |
| ***C23C 28/00*** | (2006.01) |

(52) U.S. Cl.
CPC ..... *C22C 19/058* (2013.01); *B22F 1/10* (2022.01); *B22F 1/12* (2022.01); *C22C 19/056* (2013.01); *C23C 28/3455* (2013.01); *B22F 2301/15* (2013.01)

(58) Field of Classification Search
None
See application file for complete search history.

(56) References Cited

U.S. PATENT DOCUMENTS

| | | | | |
|---|---|---|---|---|
| 9,309,780 | B2 * | 4/2016 | Li | C23C 28/022 |
| 2006/0127660 | A1 | 6/2006 | Kuenzler | |
| 2016/0168667 | A1 | 6/2016 | Li | |

FOREIGN PATENT DOCUMENTS

| | | | |
|---|---|---|---|
| DE | 102013209189 | A1 | 11/2014 |
| DE | 102013223327 | A1 | 5/2015 |
| EP | 2617870 | A1 | 7/2013 |
| WO | 2004016819 | A1 | 2/2004 |

OTHER PUBLICATIONS

PCT International Search Report and Written Opinion of International Searching Authority mailed Apr. 21, 2022 corresponding to PCT International Application No. PCT/EP2021/076389 filed Sep. 24, 2021.

Smialek, J. L., et al. "Effects of hydrogen annealing, sulfur segregation and diffusion on the cyclic oxidation resistance of superalloys: a review." Thin solid films 253.1-2 (1994): 285-292.

Nijdam, T. J., and W. G. Sloof. "Effect of reactive element oxide inclusions on the growth kinetics of protective oxide scales." Acta Materialia 55.17 (2007): 5980-5987.

* cited by examiner

*Primary Examiner* — Daniel J. Schleis
(74) *Attorney, Agent, or Firm* — Wolter Van Dyke Davis, PLLC

(57) ABSTRACT

A Nickel-based alloy which includes (in wt %): Cobalt (Co) 27.0%-29.0%; Chrome (Cr) 16.0%-18.0%; Aluminum (Al) 11.6%-12.6%; Yttrium (Y) 0.3%-0.5%; Iron (Fe) 4.0%-5.0%; optionally Tantalum (Ta) 0.6%-0.8%; Molybdenum (Mo) 0.4%-0.6%; Silicon (Si) 0.4%-0.6%; and the rest Nickel (Ni).

14 Claims, No Drawings

NICOCRAL BASED ALLOY, A POWDER, A COATING AND A COMPONENT

CROSS REFERENCE TO RELATED APPLICATIONS

This application is the US National Stage of International Application No. PCT/EP2021/076389 filed 24 Sep. 2021, and claims the benefit thereof. The International Application claims the benefit of European Application No. EP20201756 filed 14 Oct. 2020. All of the applications are incorporated by reference herein in their entirety.

FIELD OF INVENTION

The invention relates to a composition of a NiCoCrAl based alloy, especially used for gas turbines, a powder, a coating and a component.

BACKGROUND OF INVENTION

When further increasing engine efficiency, output power, availability and reliability in current gas turbine development, it is often limited by temperature capacity and lifetime of protective coatings for protection against hot corrosion and oxidation and by bonding thermal barrier coating (TBC) on hot turbine components.

The currently used coatings hardly fulfill demands of further turbine development. On the other hand, they are either too expensive due to large amount of the expensive element Rhenium (Re). Looking at the recent development of NiCoCrAl based coating coatings worldwide, all focus are on adding a large amount of rear earth elements or precious metals such as Gd, La, Pt etc. in the coatings to achieve a higher temperature capacity and longer lifetime.

This trend is conflicting with the dramatic price increase of the elements in the market.

In NiCoCrAlY based coatings available today, one relies on Yttrium (Y) incorporation very much to have pegging and scavenge effects to increase oxidation and corrosion resistances of the coatings.

However, it has recently been reported that Yttrium oxide inclusions in the protective aluminum oxide scale on top of MCrAlY provide fast oxygen diffusion routes, and therefore, accelerate oxidation of the coating (Nijdam T J, Sloof W G. Acta Materialia 2007; 55:5980).

High Sulfur content >10 ppm existed in the current MCrAlY shortens coating lifetime (Smialek J L, Jayne D T, Schaeffer J C, Murphy W H. Thin Solid Films 1994; 253:285; and Smialek J L. Metallurgical Transactions A, Physical Metallurgy and Materials Science 1991; 22A:739).

This problem has not been solved yet.

SUMMARY OF INVENTION

It is therefore an aim of the invention to overcome the problems mentioned above.

The problem is solved by an alloy, by a powder, by a coating and by a layer system.

Further advantages of the invention are listed in the dependent claims which can be combined arbitrarily with each other to yield further advantages.

DETAILED DESCRIPTION OF INVENTION

This invention is to solve the problem by using recent research results and upgraded thermodynamic modelling to design an optimized and innovative NiCoCrAlX based alloy coatings applied by means of thermal spraying in air, vacuum, or protected atmosphere, physical deposition, and plating on Nickel (Ni) or cobalt (Co) based superalloys, wherein X stands for a combination of minor elements such as Y, Si, Hf, Ta, Fe, Mo and etc.

Instead of Yttrium (Y) or partial replacement of Yttrium (Y) in the current NiCoCrAlY based coatings, other minor elements are introduced to replace partly the functions of Yttrium (Y) in order to keep Yttrium (Y) content low. The idea is also to avoid or minimize the use of the expensive elements to still meet the increased demands of today's advanced gas turbines.

Introduction of Iron (Fe) allows to stabilize the Aluminum (Al) rich phases in the microstructure or in the coating and to some extent reduces consumption rate of Aluminum (Al).

Moreover, another approach in designing and manufacturing the innovative NiCOCrAlX based coatings is to reduce Sulfur (S) content to ≤10 ppm to further increase coating lifetime.

A coating thickness should be in the range of 30 μm to 800 μm depending on type of applications and application methods.

The new NiCoCrAlX based coating is Ni-based and possesses the following composition (in wt %): 27-29% Co, 16-18% Cr, 11.6-12.6% Al, 0.3-0.5% Y, 4.0-5.0% Fe, 0.6-0.8% Ta and optionally 0.4-0.6% Mo, 0.4-0.6% Si.

Therefore, the invention comprises NiCoCrAlYFeTa, NiCoCrAlYFeTaMo, NiCoCrAlYFeTaSi, NiCoCrAlYFeTaMoSi.

This invention results in NiCoCrAlX based coatings with a higher temperature capacity, longer life, and lower cost than the NiCoCrAlX coatings available today.

A powder with this alloy composition can be mixed with a binder and/or refractory metals or ceramics if used as an abrasive coating.

For turbine application especially a metallic substrate like a nickel or cobalt based superalloy is used on which the inventive coating is applied on.

The coating is applied especially by a thermal spray process, like APS, VPS or HVOF.

Even SLM, SLS or any AM technique is possible to apply coatings or to produce bulk components of this alloy.

A layer system at least comprises a metallic substrate, especially a Nickel based superalloy and at least a coating with the inventive alloy and optionally a ceramic layer on top the metallic bond and oxidation coating.

The ceramic layer comprises preferably a Zirconia based composition, partly or fully stabilized.

The invention claimed is:

1. A powder, comprising, a nickel-based alloy, consisting of, in wt %:

- Cobalt (Co) 27.0%-29.0%
- Chromium (Cr) 16.0%-18.0%
- Aluminum (Al) 11.6%-12.6%
- Yttrium (Y) 0.3%-0.5%
- Iron (Fe) 4.0%-5.0%
- Tantalum (Ta) 0.6%-0.8%
- optionally
  - Molybdenum (Mo) 0.4%-0.6%
  - Silicon (Si) 0.4%-0.6%
  - Sulfur(S)≤10 ppm, and
- a balance of nickel, a binder, and hard or ceramic particles.

2. The powder as claimed in claim 1, wherein the Cobalt (Co) is present at 28 wt %.

3. The powder as claimed in claim 1, wherein the Chromium (Cr) is present at 17.0 wt %.

4. The powder as claimed in claim 1, wherein the Aluminum (Al) is present at 12.1 wt %.

5. The powder as claimed in claim 1, wherein the Yttrium (Y) is present at 0.4 wt %.

6. The powder as claimed in claim 1, wherein the Iron (Fe) is present at 4.5 wt %.

7. The powder as claimed in claim 1, wherein the Tantalum (Ta) is present at 0.7 wt %.

8. The powder as claimed in claim 1, wherein the Molybdenum (Mo) is present at 0.4 wt %-0.6 wt %.

9. The powder as claimed in claim 8, wherein the Molybdenum (Mo) is present at 0.5 wt %.

10. The powder as claimed in claim 1, wherein the Silicon (Si) is present at 0.4 wt %-0.6 wt %.

11. The powder as claimed in claim 10, wherein the Silicon (Si) is present at 0.5 wt %.

12. The powder according to claim 1, wherein the alloy is NiCoCrAlYFeTaMo.

13. The powder according to claim 1, wherein the alloy is NiCoCrAlYFeTaSi.

14. The powder according to claim 1, wherein the alloy is NiCoCrAlYFeTaMoSi.

* * * * *